US009506647B2

(12) United States Patent
Ma

(10) Patent No.: US 9,506,647 B2
(45) Date of Patent: Nov. 29, 2016

(54) GAS DEVICE WITH INCREASED FUEL EVAPORATION EFFICIENCY

(71) Applicant: Pro-Iroda Industries, Inc., Taichung (TW)

(72) Inventor: Wei-Cheng Ma, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 289 days.

(21) Appl. No.: 14/331,257

(22) Filed: Jul. 15, 2014

(65) Prior Publication Data

US 2016/0018106 A1 Jan. 21, 2016

(51) Int. Cl.

| | |
|---|---|
| ***F23D 14/28*** | (2006.01) |
| ***F24H 3/00*** | (2006.01) |
| ***F24H 9/20*** | (2006.01) |

(52) U.S. Cl.

CPC ..... *F23D 14/28* (2013.01); *F24H 3/006* (2013.01); *F24H 9/2085* (2013.01)

(58) Field of Classification Search

USPC ..... 431/344, 346; 126/85 R, 42

See application file for complete search history.

(56) References Cited

U.S. PATENT DOCUMENTS

| | | | | |
|---|---|---|---|---|
| 4,971,224 | A * | 11/1990 | Scremin | B65D 83/425 126/52 |
| 2004/0180306 | A1* | 9/2004 | Tsai | F23D 14/06 431/255 |
| 2014/0338660 | A1* | 11/2014 | Kelly | F23C 13/06 126/85 R |

FOREIGN PATENT DOCUMENTS

| | | | |
|---|---|---|---|
| CN | 2199375 | Y | 5/1995 |
| JP | 2004277668 | A | 10/2004 |
| TW | M247795 | U | 10/2004 |
| TW | M337703 | U | 8/2008 |

* cited by examiner

*Primary Examiner* — Avinash Savani

(74) *Attorney, Agent, or Firm* — Alan D. Kamrath; Kamrath IP Lawfirm, P.A.

(57) ABSTRACT

A gas device with increased fuel evaporation efficiency includes a fuel reservoir with an outlet and a combustion device connecting to the fuel reservoir with a joint, with the joint engaging with the outlet of the fuel reservoir. The combustion device includes a burner head for fuel combustion disposed apart from the joint, with the burner head disposed at different horizontal positions and different vertical positions, and with the burner head disposed at a height from the fuel reservoir lower than a height of the burner head from the fuel reservoir. The combustion device also includes a communication channel interconnecting the joint and the burner head.

17 Claims, 9 Drawing Sheets

GAS DEVICE WITH INCREASED FUEL EVAPORATION EFFICIENCY

BACKGROUND OF THE INVENTION

1. Field of the Invention

The present invention relates to a gas device and, particularly, to a gas device with increased fuel evaporation efficiency.

2. Description of the Related Art

TW Patent No. M247795 shows a recreational lightweight and portable stove. The stove includes a connecting head. The connecting head is connectable to a gas can. The connecting head includes an adjusting screw which controls gas output amounts. Moreover, the stove includes a guiding conduit and an adjusting ring sleeved on the guiding conduit. The guiding conduit includes a plurality of vents, and the adjusting ring includes a plurality of vents associated with those of the guiding conduit. The plurality of vents of the adjusting ring can correspond to those of the guiding conduit. A transit conduit interconnects the connecting head and the guiding conduit. Moreover, the stove includes a burner. The burner is supported by four footstands. Gas flows in the connecting head, the transit conduit, the guiding conduit, and the burner sequentially. However, this stove does not increase fuel evaporation efficiency substantially. In addition, the stove has no safety means, so it is dangerous if the gas can tips over, for example.

The present invention is, therefore, intended to obviate or at least alleviate the problems encountered in the prior art.

SUMMARY OF THE INVENTION

According to the present invention, a gas device with increased fuel evaporation efficiency includes a fuel reservoir with an outlet and a combustion device connecting to the fuel reservoir with a joint, with the joint engaging with the outlet of the fuel reservoir. The combustion device includes a burner head for fuel combustion disposed apart from the joint, with the burner head disposed at different horizontal positions and different vertical positions, and with the burner head disposed at a height from the fuel reservoir lower than a height of the joint from the fuel reservoir. The combustion device also includes a communication channel interconnecting the joint and the burner head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
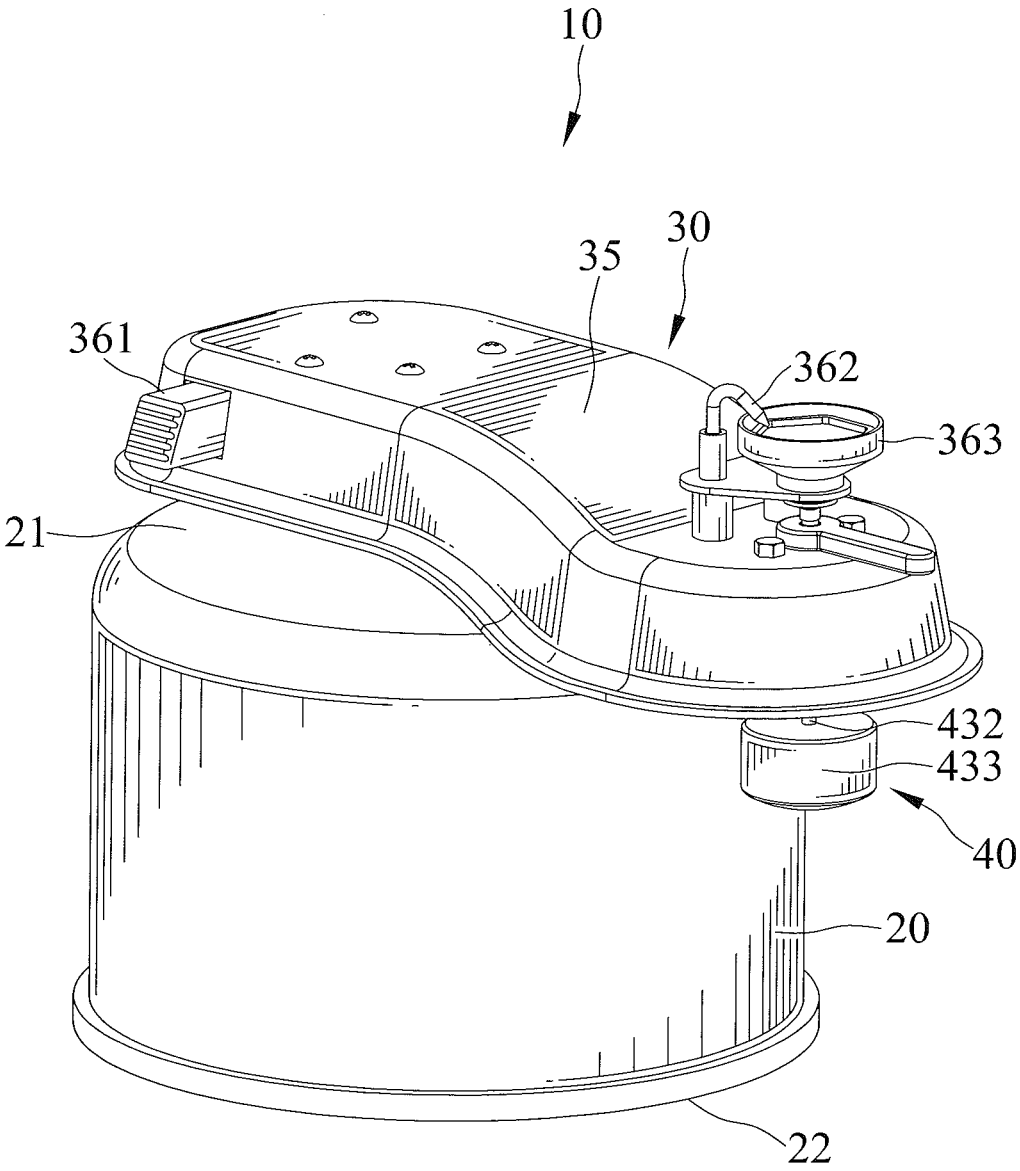
FIG. 1 is a perspective view of a gas device with increased fuel evaporation efficiency in accordance with the present invention.
Figure 2:
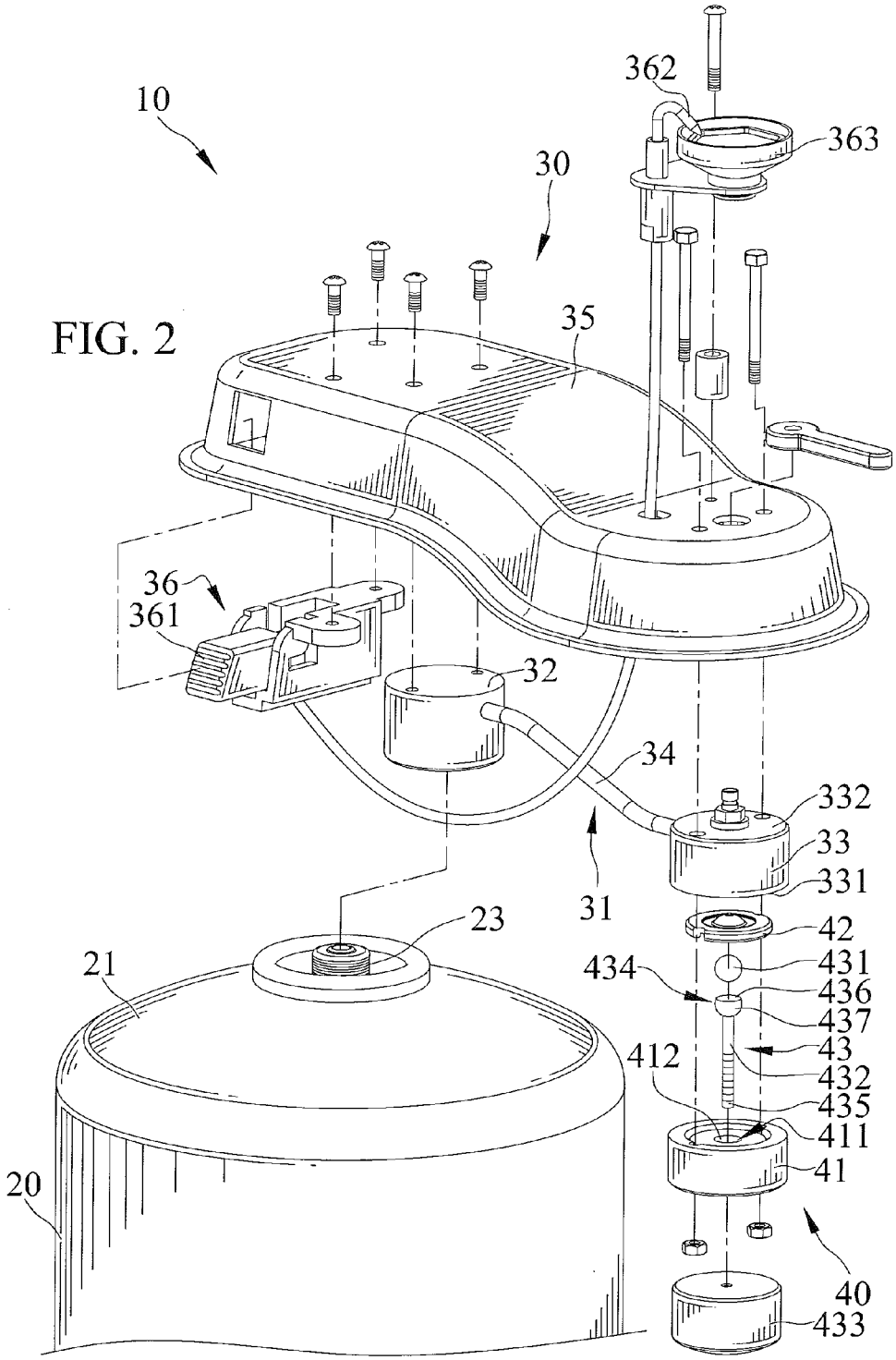
FIG. 2 is a partial, exploded perspective view of the gas device of FIG. 1.
Figure 3:
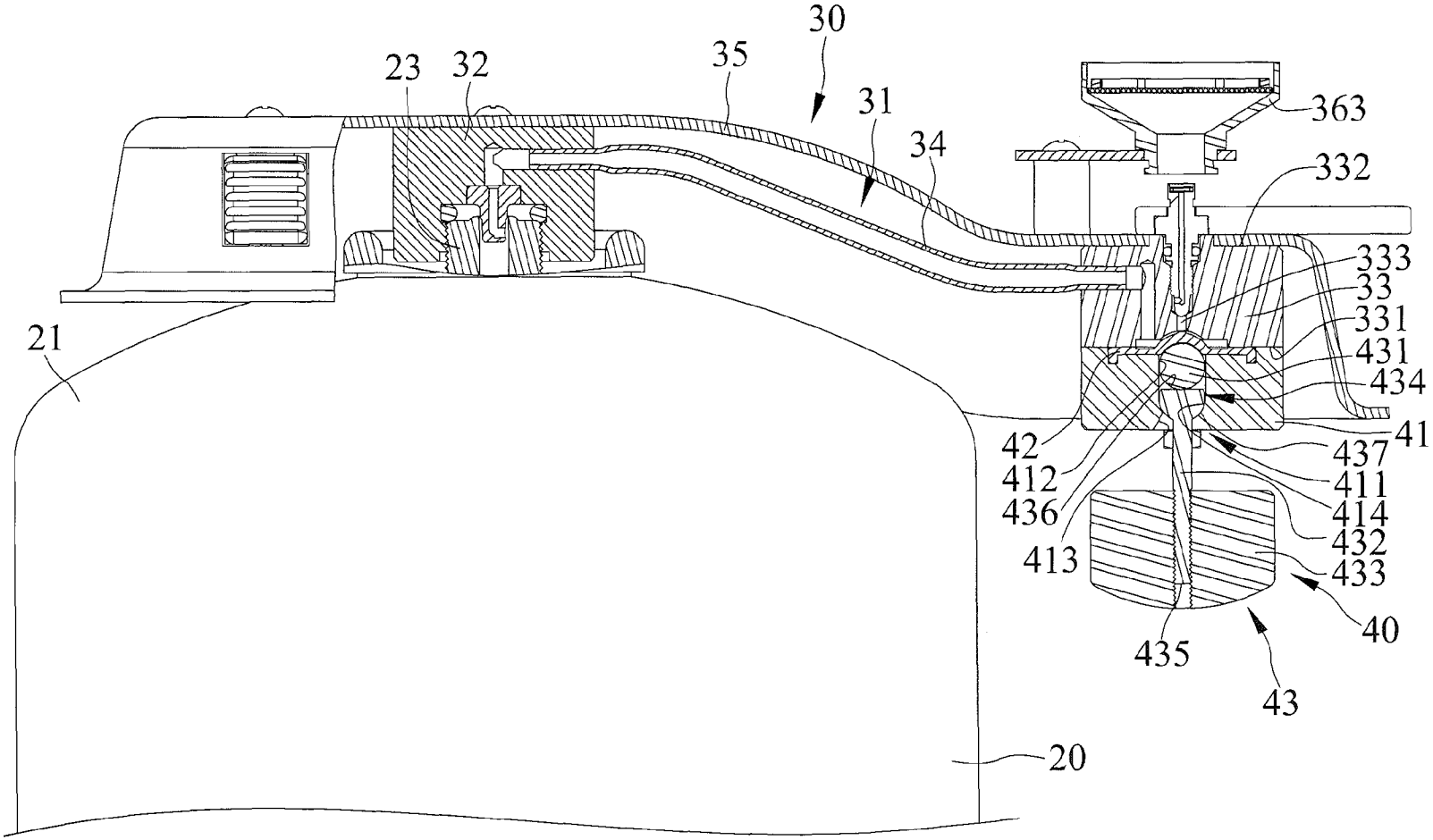
FIG. 3 is a partial, cross-sectional view taken along line 3-3 of FIG. 1.
Figure 4:
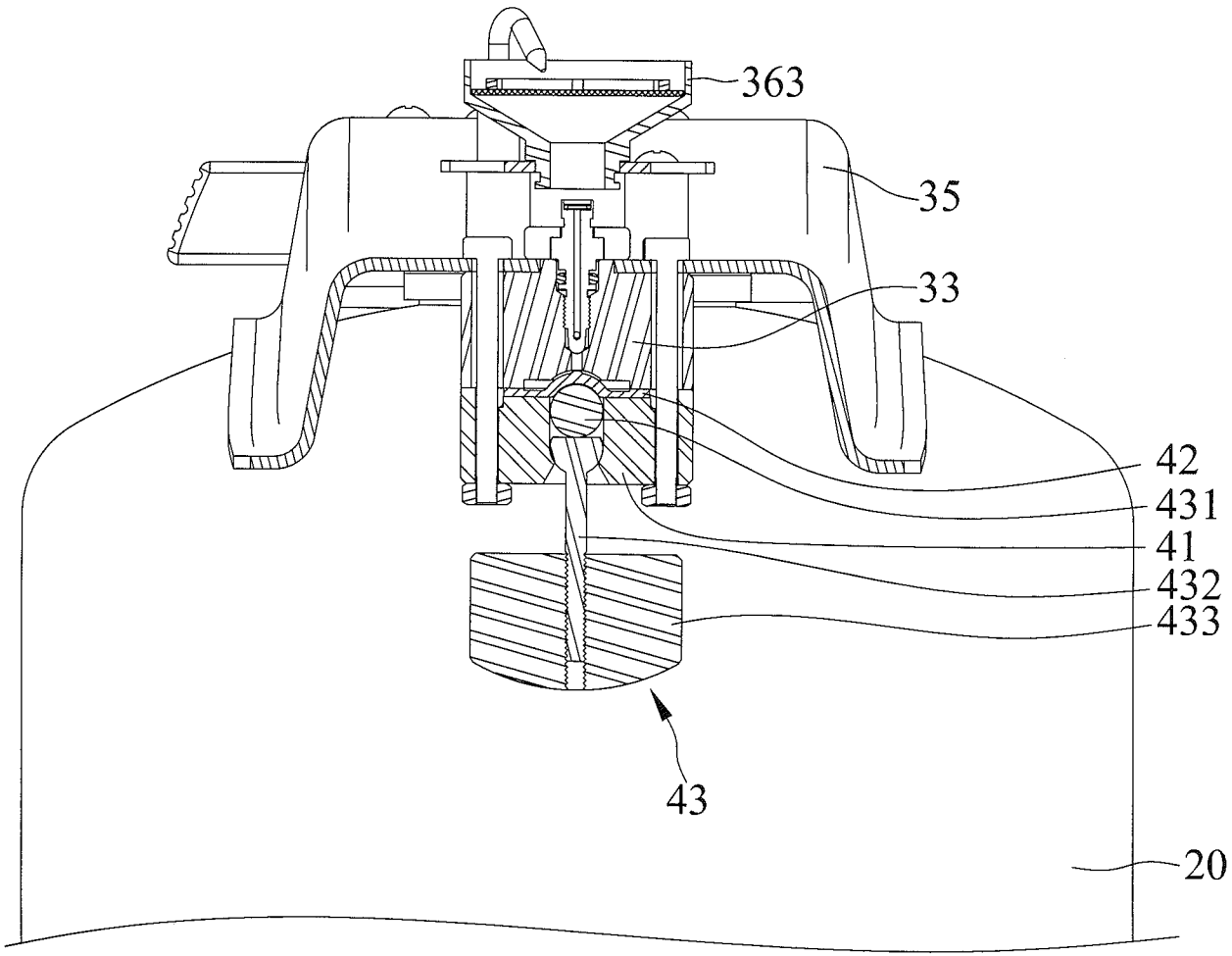
FIG. 4 is a partial, cross-sectional view taken along line 4-4 of FIG. 1.

FIGS. 1 through 9 show a gas device 10 with increased fuel evaporation efficiency in accordance with the present invention including a fuel reservoir 20 and a combustion device 30.

The fuel reservoir 20 has an outlet 23. The fuel reservoir 20 defines a first end 21 and a second end 22 opposite to the first end 21. The top and bottom of the fuel reservoir 20 are at the first and second ends 21 and 22 thereof, respectively.

The combustion device 30 connects to the fuel reservoir 20 with a joint 32, with the joint 32 engaging with the outlet 23 of the fuel reservoir 20. The combustion device 30 includes a burner head 33 for fuel combustion disposed apart from the joint 32, with the burner head 33 disposed at different horizontal positions and different vertical positions, and with the burner head 33 disposed at a height from the fuel reservoir 20 lower than a height of the joint 32 from the fuel reservoir 20. The joint 32 and the burner head 33 are disposed in the casing 35. The combustion device 30 includes a communication channel 31 interconnecting the joint 32 and the burner head 33. The communication channel 31 is disposed inside the casing 35. The communication channel 31 defines a pipe 34. The pipe 34 has a first end joined to the joint 32 and a second end joined to the burner head 33. The pipe 34 extends at an incline between the joint 32 to the burner head 33. Since the communication channel 31, the joint 32, and the burner head 33 are disposed inside the casing 35, the gas device 10 looks neater. Moreover, the casing 35 shields and prevents the communication channel 31, the joint 32, and the burner head 33 from getting dirty. Moreover, the casing 35 reduces heat loss. The combustion device 30 includes an ignition system 36 for ignition of fuel in the burner head 33. The gas device 10 produces a flame outside the casing 35 after ignition. The ignition system 36 includes a control input 361 and a spark electrode 362 connecting to the control input 361. The control input 361 is fixed on the casing 35. The spark electrode 362 is disposed outside the casing 35. Further, a flame holder 363 holds the flame produced by the gas device 10. The flame holder 363 and the burner head 33 fluidly connect with each other. The flame holder 363 is disposed adjacent to a fuel outlet port of the burner head 33. The flame holder 363 is disposed outside the casing 35. In addition, the flame produced by the gas device 10 burns in an upward direction, and the flame holder 363 is disposed above the burner head 33 in the upward direction. The burner head 33 defines a first end 331 and a second end 332 opposite to the first end 331. The burner head 33 delimits a passage 333 in which fuel flows.

The gas device 10 also includes a safety device 40 selectively blocking a fuel inlet port of the burner head 33. The safety device 40 is disposed adjacent to the burner head 33. The flame holder 363 is disposed above the burner head 33, but the safety device 40 is disposed under the burner head 33. The fuel inlet and outlet ports of the burner head 33 are defined at two distal ends of the passage 333, respectively. The safety device 40 has a first operation position in which the fuel inlet port is not blocked and fluidly connects to the communication channel 31 and a second operation position in which the fuel inlet port is blocked. The safety device 40 includes a seat 41 and an elastomer 42. The seat 41 bears the elastomer 42. The seat 41 connects to the burner head 33. The elastomer 42 is disposed corresponding to the fuel inlet port of the burner head 33. The elastomer 42 is adapted to be moved between a first position not blocking the fuel inlet port and a second position blocking the fuel inlet port. The safety device 40 includes a drive mechanism 43 interacting with the elastomer 42. The drive mechanism 43 has a first interacting position in which the elastomer 42 is in the first position thereof and a second interacting position in which the elastomer 42 is in the second position thereof. The drive mechanism 43 connects to the seat 41 and swingable to the first and second interacting positions. The seat 41 delimits a space 411 and the drive mechanism 43 includes a striking member 431, a rod 432, and a bob 433. The space 411 defines a first section 412 and a second section 413. The rod 432 includes a head 434 bearing the striking member 431, and the striking member 431 pushes and abuts against the elastomer 42 to block the fuel inlet port. The striking member 431 moves in the first section 412 of the space 411 in an axial direction when the drive mechanism 43 swings. The head 434 of the rod 432 forms a flat edge 436 bearing the striking member 431. The striking member 431 is in a form of a sphere. The striking member 431 and the head 434 of the rod 432 are disposed in the first section 412 of the space 411. An external diameter of the striking member 431 and an inner diameter of a peripheral wall 414 in the first section 412 of the space 411 are substantially the same. A circumferential edge of the head 434 of the rod 432 is arcuate. The peripheral wall 414 in the first section 412 of the space defines an arcuate abutting area 437 conformingly receiving the circumferential edge of the head of the rod. A shoulder protrudes diametrically from the peripheral wall 414 and between the first and second sections 412 and 413 of the space 411. The shoulder restrains the head 434 of the rod 432 from moving in the space 411 from the first section 412 to the second section 413 thereof The rod 432 includes a body 435 extending outside the space 411. The bob 433 connects to the body 435 of the rod 432 and is disposed outside the space 411. The body 435 of the rod 432 extends from the head 434 of the rod 432. The body 435 of the rod 432 inserts through the second section 413 of the space 411. The peripheral wall 414 in the second section 413 of the space 411 extends diametrically outward from the peripheral wall 414 in the first section 412 of the space 411 to an extent determining a swing extent of the rod 432 of the driving mechanism 43.

Figure 5:
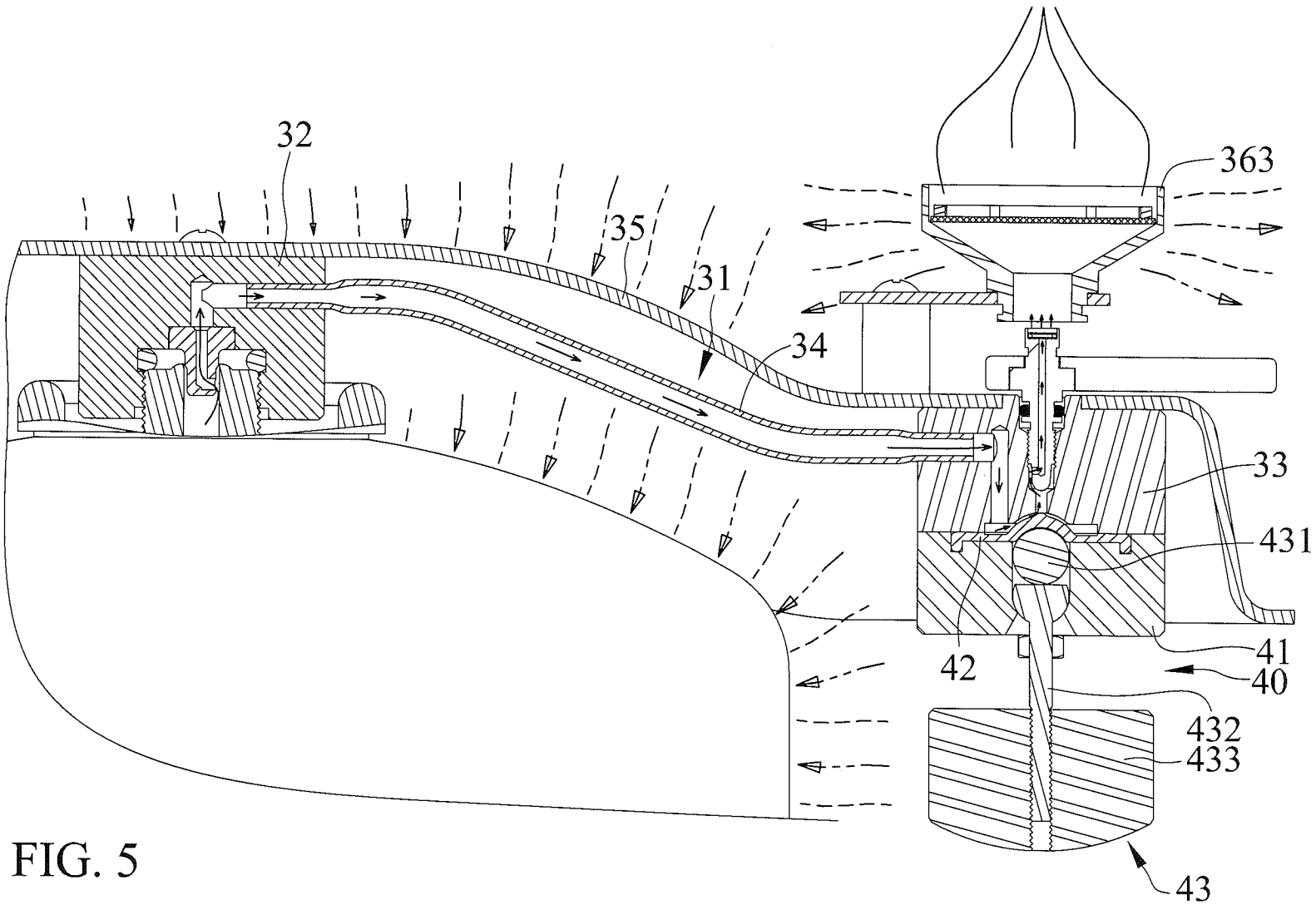
FIG. 5 is a partial, cross-sectional view of FIG. 3 showing the gas device in operation and producing a flame.

As shown in FIG. 5, the joint 32 and the burner head 33 are disposed apart from each other and, particularly, as set forth above, result in more efficient thermal convection and causes fuel in the fuel reservoir 20 to evaporate more efficiently and fast when the gas device 10 is in operation. Therefore, the gas device 10 produces a stable flame.

Figure 6:
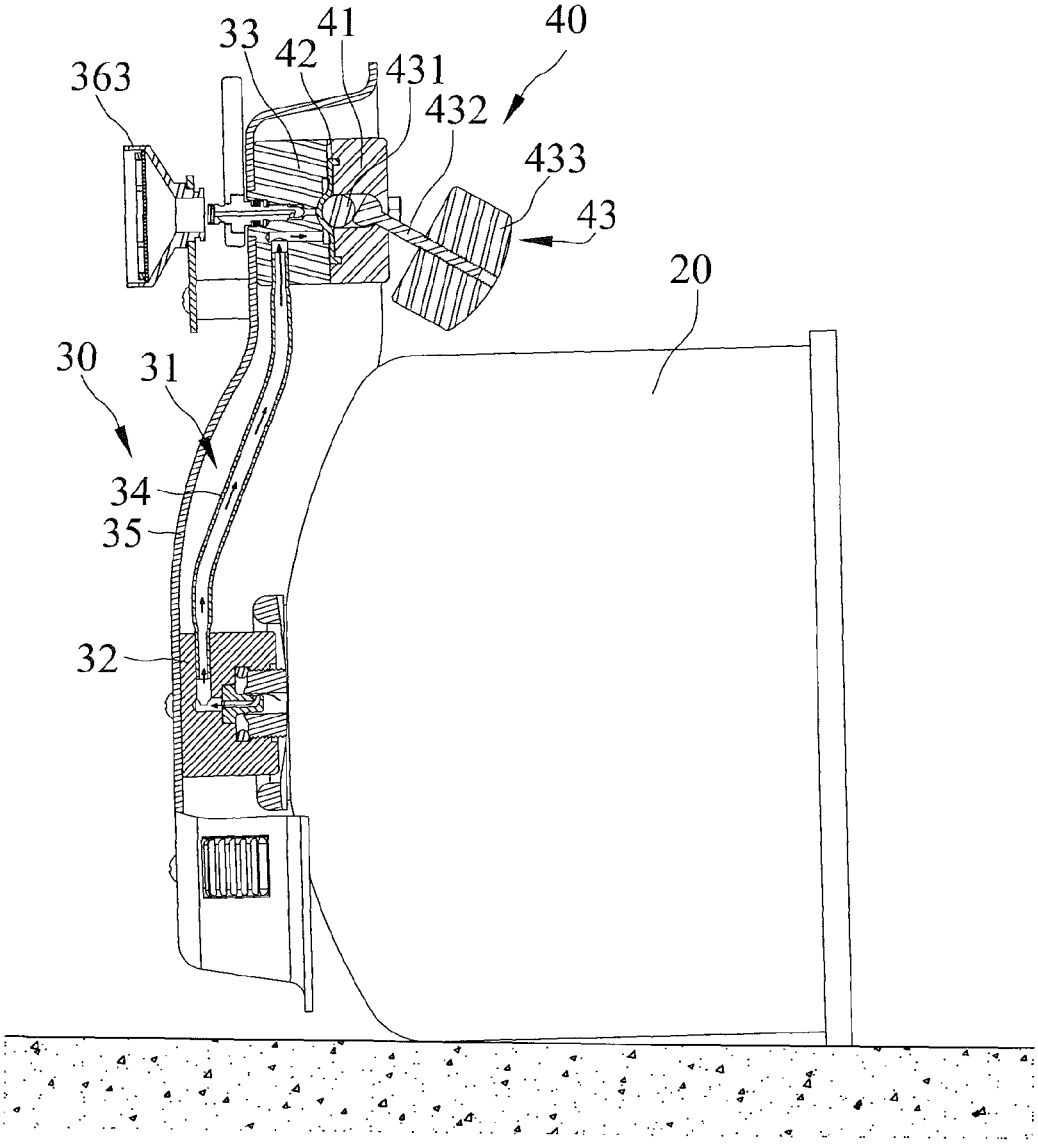
FIG. 6 shows the gas device of the present invention being tipped over from a normal operating position thereof producing the flame and in which a safety device precludes gas from flowing into a burner head of a combustion device in the gas device.
Figure 7:
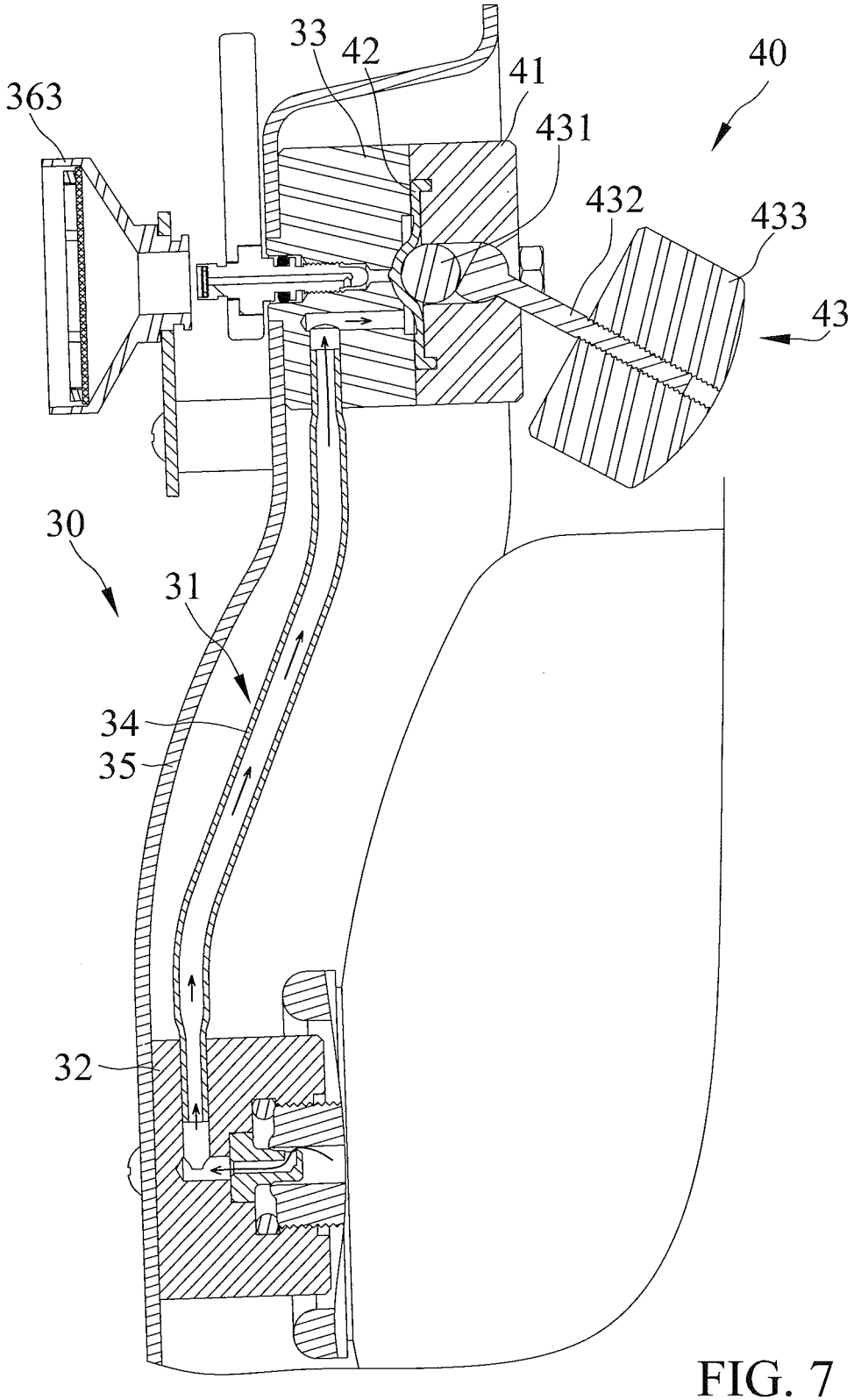
FIG. 7 is an enlarged view of FIG. 6, with arrows indicating gas flows.
Figure 8:
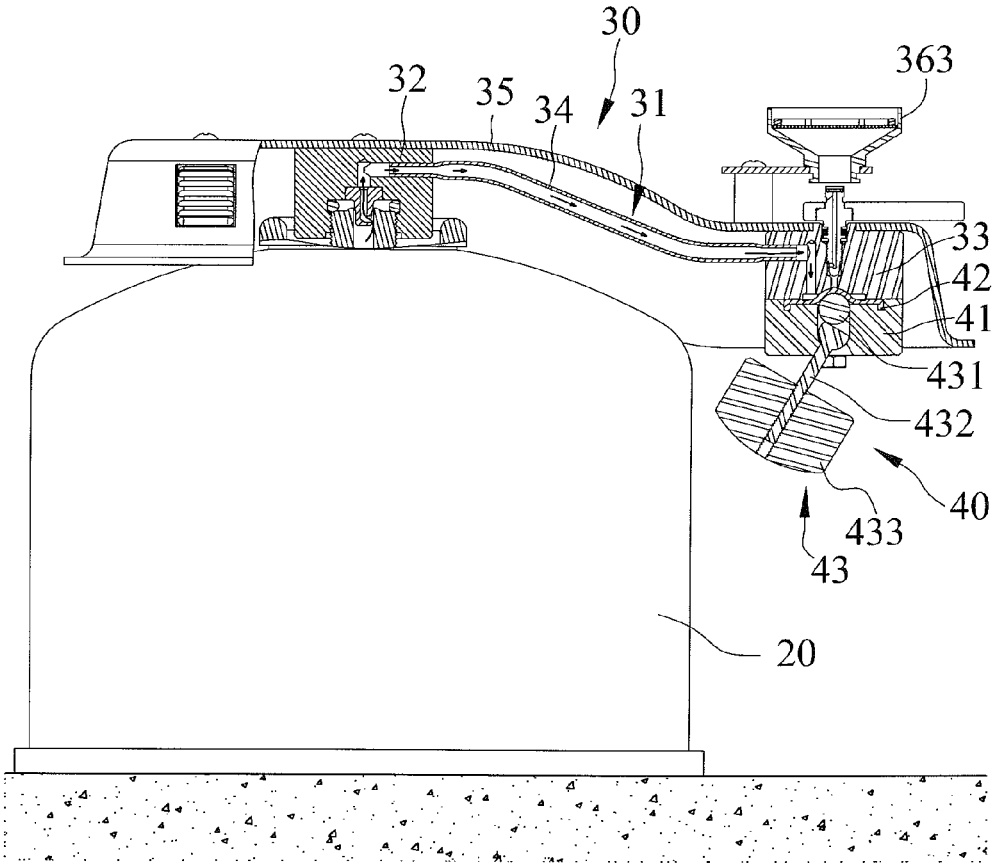
FIG. 8 shows the safety device precluding gas from flowing into the burner head of the combustion device when the gas device is in the normal operating position thereof.
Figure 9:
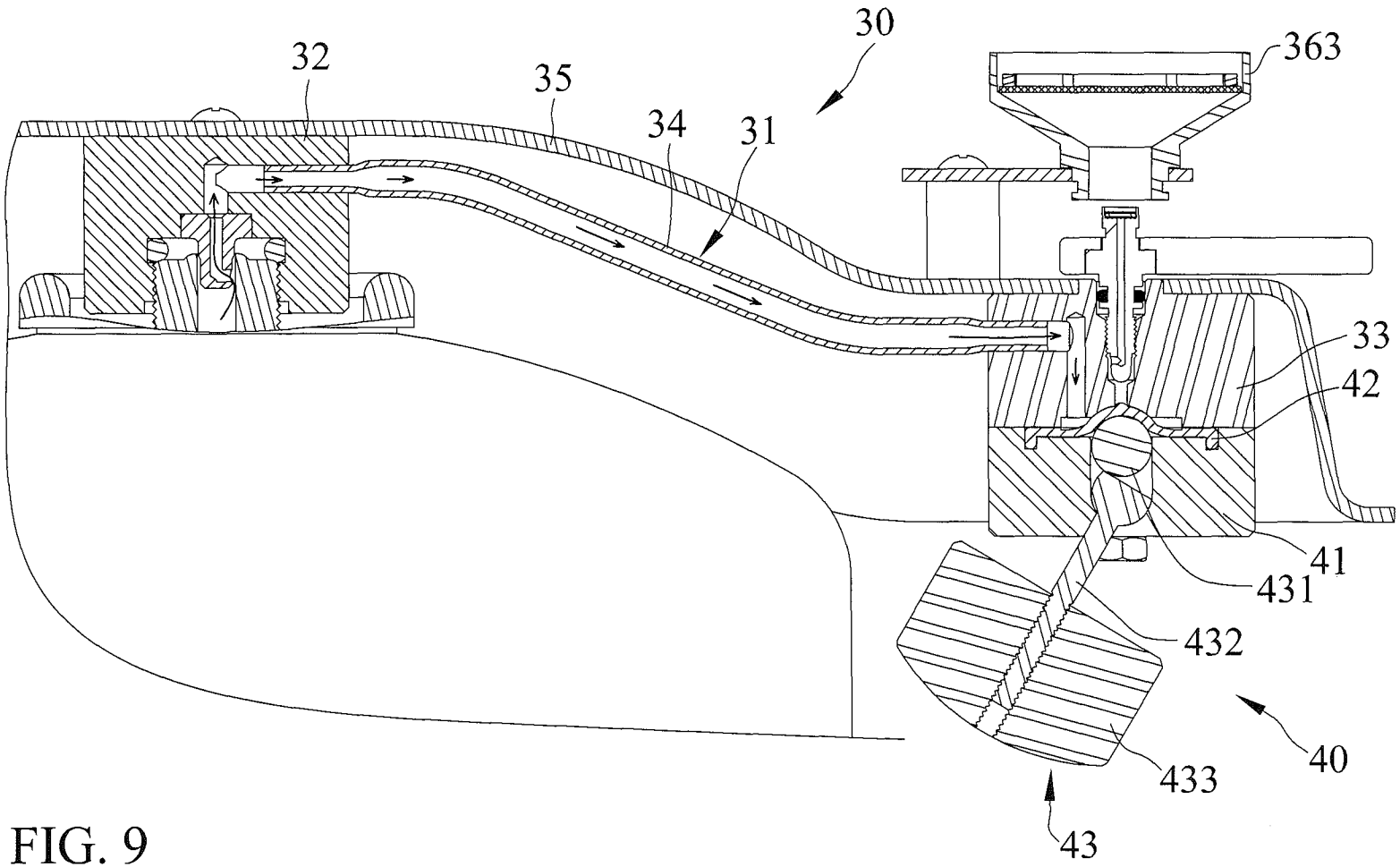
FIG. 9 is an enlarged view of FIG. 7, with arrows indicating gas flows.

In addition, as shown in FIG. 6, the gas device 10 is tipped over from a normal operating position thereof producing the flame and in which a safety device 40 precludes gas from flowing into a burner head 33 of a combustion device 30 in the gas device 10.

In view of the forgoing, the present invention discloses a gas device 10 with increased fuel evaporation efficiency in that the joint 32 and the burner head 33 are disposed apart from each other. Fuel flows out of the fuel reservoir 20 to the joint 32 through the outlet 23, and flows out of the joint 32 to the burner head 33 through the communication channel 31.

The foregoing is merely illustrative of the principles of this invention, and various modifications can be made by those skilled in the art without departing from the scope and spirit of the invention.

What is claimed is:

1. A gas device with increased fuel evaporation efficiency comprising:

a fuel reservoir with an outlet;

a combustion device connecting to the fuel reservoir with a joint, with the joint engaging with the outlet of the fuel reservoir, with the combustion device including a burner head for fuel combustion disposed apart from the joint, with the burner head disposed at different horizontal positions and different vertical positions, with the combustion device including a communication channel interconnecting the joint and the burner head; and a safety device selectively blocking a fuel inlet port of the burner head, wherein the safety device has a first operation position in which the fuel inlet port is not blocked and fluidly connects to the communication channel and a second operation position in which the fuel inlet port is blocked, wherein the safety device includes a seat and an elastomer, with the seat bearing the elastomer, with the seat connecting to the burner head, with the elastomer disposed corresponding to the fuel inlet port of the burner head, and with the elastomer adapted to be moved between a first position not blocking the fuel inlet port and a second position blocking the fuel inlet port.

2. The gas device as claimed in claim 1, wherein the safety device includes a drive mechanism interacting with the elastomer, with the drive mechanism having a first interacting position in which the elastomer is in the first position thereof and a second interacting position in which the elastomer is in the second position thereof.

3. The gas device as claimed in claim 2, wherein the drive mechanism connects to the seat and swingable to the first and second interacting positions.

4. The gas device as claimed in claim 3, wherein the seat delimits a space and the drive mechanism includes a striking member, a rod, and a bob, with the space defining a first section and a second section, with the rod including a head bearing the striking member and the striking member pushing and abutting against the elastomer to block the fuel inlet port, with striking member and the head of the rod disposed in the first section, with a shoulder protruding diametrically from a peripheral wall and between the first and second sections of the space, with the shoulder restraining the head of the rod from moving in the space from the first section to the second section thereof, with the rod including a body extending outside the space, and with the bob connecting to the body of the rod and disposed outside the space.

5. The gas device as claimed in claim 4, wherein the peripheral wall in the second section of the space extends diametrically outward from the peripheral wall in the first section of the space to an extent determining a swing extent of the rod of the driving mechanism.

6. The gas device as claimed in claim 4, wherein the head of the rod forms a flat edge bearing the striking member.

7. The gas device as claimed in claim 4, wherein the striking member moves in the first section of the space in an axial direction when the drive mechanism swings.

8. The gas device as claimed in claim 7, wherein the striking member is in a form of a sphere.

9. The gas device as claimed in claim 8, wherein an external diameter of the striking member and an inner diameter of the peripheral wall in the first section of the space are substantially the same.

10. The gas device as claimed in claim 4, wherein a circumferential edge of the head of the rod is arcuate, and wherein the peripheral wall in the first section of the space defines an arcuate abutting area conformingly receiving the circumferential edge of the head of the rod.

11. The gas device as claimed in claim 1, wherein the burner head is disposed at a height from the fuel reservoir lower than a height of the joint from the fuel reservoir.

12. The gas device as claimed in claim 11 further comprising a casing, and wherein the communication channel is disposed inside the casing.

13. The gas device as claimed in claim 11, wherein the joint and the burner head are disposed in the casing.

14. The gas device as claimed in claim 13, wherein the combustion device includes an ignition system for ignition of fuel in the burner head, and wherein the gas device produces a flame outside the casing after ignition.

15. The gas device as claimed in claim 14, wherein the ignition system includes a control input and a spark electrode connecting to the control input.

16. The gas device as claimed in claim 15 further comprising a flame holder holding the flame produced by the gas device, wherein the flame holder and the burner head fluidly connect with each other, and wherein the flame holder is disposed adjacent to a fuel outlet port of the burner head.

17. The gas device as claimed in claim 16, wherein the flame produced by the gas device burns in an upward direction, and wherein the flame holder is disposed above the burner head in the upward direction.

* * * * *